US007530136B1

(12) United States Patent
Ball

(10) Patent No.: US 7,530,136 B1
(45) Date of Patent: May 12, 2009

(54) POWER WINDOW WASHER

(76) Inventor: Christopher E. Ball, P.O. Box 34, Shelton, WA (US) 98584

( * ) Notice: Subject to any disclaimer, the term of this patent is extended or adjusted under 35 U.S.C. 154(b) by 0 days.

(21) Appl. No.: 12/106,718

(22) Filed: Apr. 21, 2008

(51) Int. Cl.
*A47L 1/05* (2006.01)

(52) U.S. Cl. ..... 15/103; 15/23; 15/24

(58) Field of Classification Search ..... 15/23, 15/24, 28, 29, 50.1, 50.3, 52, 97.1, 98, 103
See application file for complete search history.

(56) References Cited

U.S. PATENT DOCUMENTS

| | | | | | |
|---|---|---|---|---|---|
| 1,515,406 | A | * | 11/1924 | Peterson | 15/103 |
| 3,396,417 | A | * | 8/1968 | Starr | 15/29 |
| 3,501,798 | A | * | 3/1970 | Carraro | 15/320 |
| 3,724,017 | A | | 4/1973 | Mallory | |
| 3,968,535 | A | | 7/1976 | Nichols, Jr. | |
| 4,208,753 | A | * | 6/1980 | Lewis | 15/29 |
| 4,399,578 | A | * | 8/1983 | Bordeaux | 15/97.1 |
| 5,289,605 | A | * | 3/1994 | Armbruster | 15/97.1 |
| 5,862,562 | A | | 1/1999 | Erken | |
| 5,964,003 | A | * | 10/1999 | Rogers | 15/98 |
| 7,159,275 | B2 | | 1/2007 | Chang | |
| 2004/0117931 | A1 | * | 6/2004 | Washington et al. | 15/29 |

FOREIGN PATENT DOCUMENTS

GB 2261814 * 6/1993

* cited by examiner

*Primary Examiner*—Mark Spisich
(74) *Attorney, Agent, or Firm*—Crossley Patent Law; Mark A. Crossley

(57) ABSTRACT

A powered window washer used for scrubbing and cleaning a window or glass of an automobile. The device contains a battery-powered scrubbing head that rotationally spins to scrub away debris from a window. The device further has internally stored washing fluid, which may be released by depressing a fluid activation button, an extendable handle assembly, a multiple-positioning washing head, a squeegee and scraping blades.

5 Claims, 4 Drawing Sheets

POWER WINDOW WASHER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates to window washers, more specifically, to a powered window washer, which contains a battery-powered scrubber, a washing fluid container and a telescopic handle.

BACKGROUND OF THE INVENTION

When an automobile windshield becomes dirty or covered with debris, a driver has few choices in the type of device he may use. Currently most available window scraping and window washing devices merely perform a single action such as ice scraping or squeegeeing. Both methods are performed manually. The present device allows a user to perform multiple actions while simultaneously using a powered scrubbing device. A user may now perform any window-washing task with ease and convenience. The present device gives a user a tool that may be carried in the automobile and used at any given moment. A user no longer has to wait until he arrives at a gas station to clean his soiled windshield. He may clean debris off whenever he wishes.

SUMMARY OF THE INVENTION

The present powered window washer is a telescopic windshield-washing device, which uses battery power to activate an absorbent abrasive roller used to scrape hardened debris from a windshield. The present device comes equipped with a squeegee for clearing excess washing fluid away and a serrated scraper for scraping away ice.

The present device, in a preferred embodiment, is equipped with a telescopic handle that allows a user to extend or retract the length of the present device. The preferred size of the handle of the present device has a retracted length of 24" extendable to a length of 48". The adjustable length allows a user to extend the present device to accommodate use with larger vehicles such as semi-trucks and RV's.

An electric motor, powered by batteries held in the handle, is provided within the head of the present powered window-washing device. This motor rotationally turns an abrasive absorbent scrubbing roller to clean hardened debris from a windshield.

Washing fluid is contained within an internal washing fluid tank. The fluid may be excreted from the tank by depressing a fluid activation button located on the telescopic handle assembly. This feature allows a user to clean a windshield in virtually an occasion.

A swivel assembly connects the washing head to the telescopic handle. This swivel allows a user to set the washing head of the present device in a variety of positions for a comfortable using experience.

In an alternative embodiment the present device may be constructed using a fixed length handle assembly allowing the device to be stored in small spaces. The use of a fixed length device would optimally be used on compact cars and smaller household tasks. The length is provided in a variety of lengths such as 12, 18, and 24 inches.

To use the device, a user retains the device from its convenient storage compartment or area within their vehicle. The user extends or contracts the handle to a desired length and turns the power on which activates the scrubbing roller. The user places the device on a windshield or other surface to be cleaned. While the roller scrubs the hardened debris away from the windshield, the user may also apply a desired amount of washing fluid by depressing the fluid activation button. A squeegee located along the lead edge of the present device is used to scrape away excess wet material. When the job is complete and the window is clean the user replaces the present device back into its storage area within the vehicle.

One object of the present powered window washer is to provide a scrubbing apparatus.

Another object of the present powered window washer is to provide a washing device.

Yet another object of the present powered window washer is to provide an ice scraping apparatus.

As such, the general purpose of the powered window washer which has all of the advantages of the prior art mentioned heretofore and many novel features that result in an improved powered window washer which is not anticipated, rendered obvious, suggested, or even implied by the prior art, either alone or in combination thereof.

Thus has been broadly outlined the more important features of the improved powered window washer so that the detailed description thereof that follows may be better understood and in order that the present contribution to the art may be better appreciated.

These together with additional objects, features and advantages of the improved powered window washer will be readily apparent to those of ordinary skill in the art upon reading the following detailed description of presently preferred, but nonetheless illustrative, embodiments of the improved powered window washer when taken in conjunction with the accompanying drawings. In this respect, before explaining the current embodiments of the improved powered window washer in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved powered window washer. It is therefore important that the claims be regarded as including such equivalent constructions insofar as they do not depart from the spirit and scope of the present invention.

Objects of the improved powered window washer, along with various novel features that characterize the invention are particularly pointed out in the claims forming a part of this disclosure. For better understanding of the improved powered window washer, its operating advantages and specific objects attained by its uses, refer to the accompanying drawings and description.

DETAILED DESCRIPTION OF THE DRAWINGS

Figure 1:
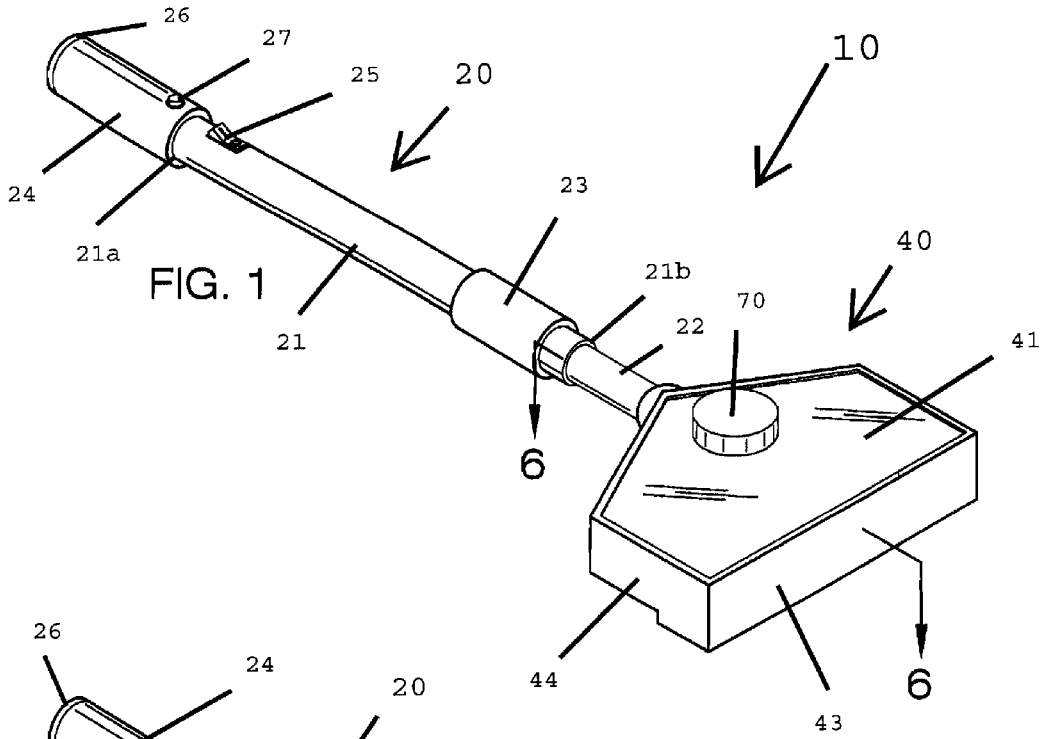
FIG. 1 is a top perspective view.
Figure 2:
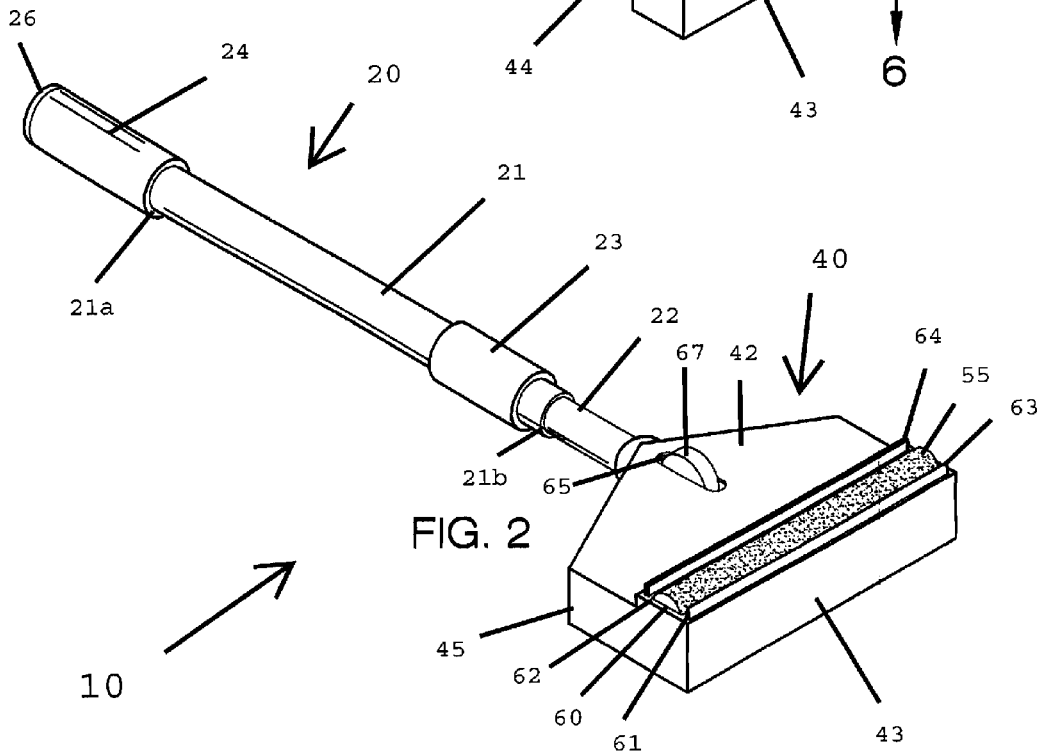
FIG. 2 is a bottom perspective view.

With reference now to the drawings, and in particular FIGS. 1 through 7 thereof, examples of the employing the principles and concepts of the present powered window washer, generally designated by the reference number 10, will be described.

Referring to FIGS. 1 through 6, a preferred embodiment of the present powered window washer 10 comprises a telescopic handle assembly 20, a swivel assembly 30 and a washing head assembly 40.

Figure 3:
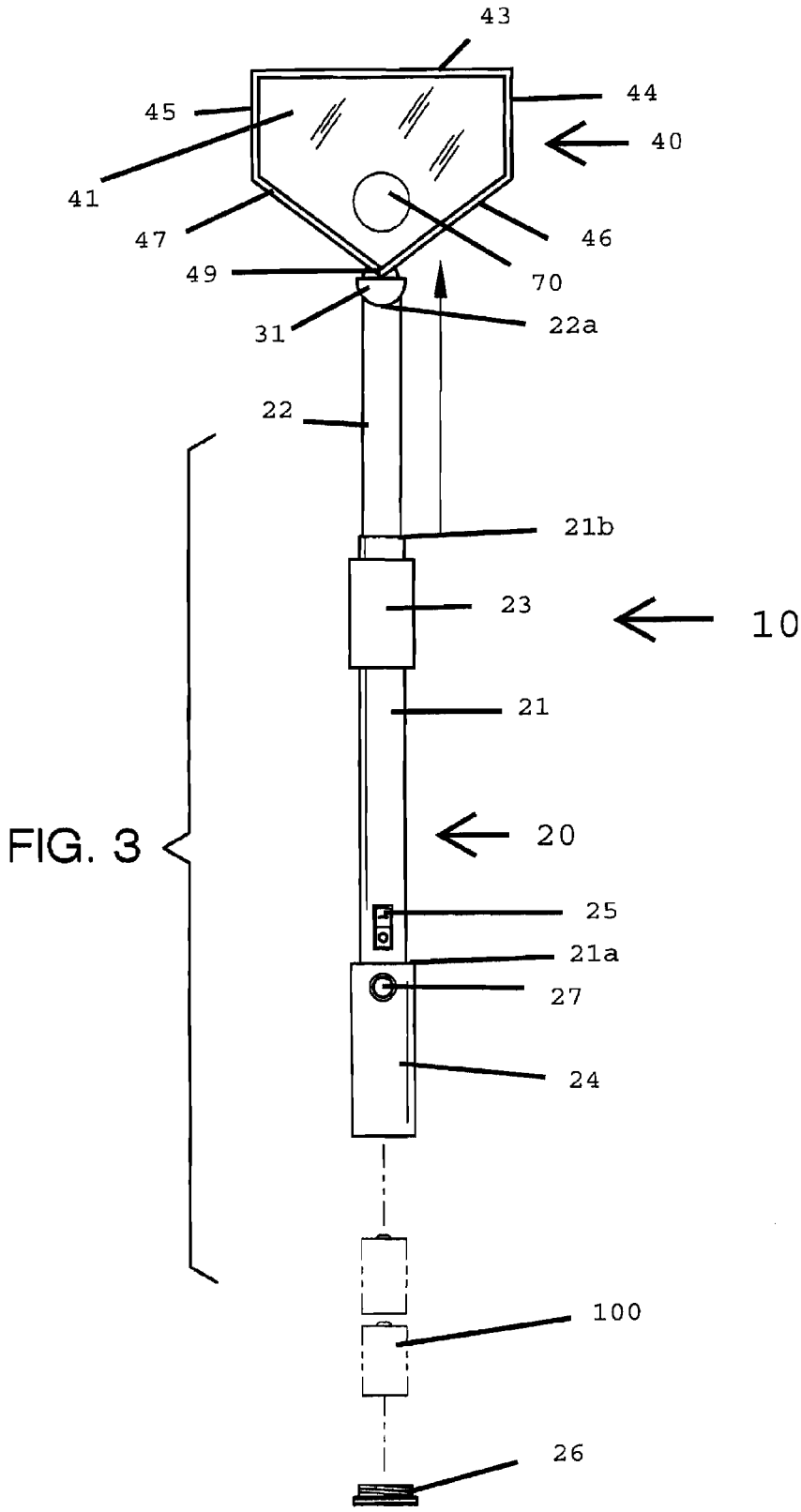
FIG. 3 is a top plan view.
Figure 4:
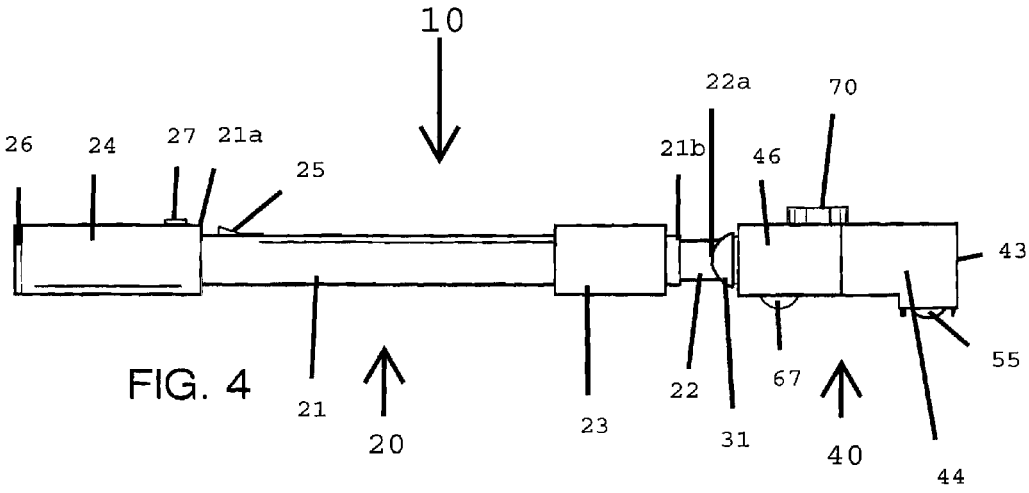
FIG. 4 is a side elevation view.

The telescopic handle assembly 20 consists of an external section 21 and an internal section 22. Both the external section 21 and the internal sections 22 are constructed of hollow cylindrical pipe. As illustrated in FIG. 3, the external section 21 is designed to slide over the internal section 22 whereby the combination and movement of external section 21 over internal section 22 creates an extendable handle for the powered window washer 10. To increase or decrease the length of the handle assembly 20, a user first twists the external section 21 releasing an internal locking mechanism (not shown), retracts or extends the external section 21 to a desired length, then twists the external section 21 back into its original position thereby relocking the handle assembly 20 in its new desired length. The external section 21 has a first end 21*a* and a second end 21*b* and is fitted with a cylindrical soft grip 23 over the exterior surface of the external section 21, and is located in close proximity to the second end 21*b* of the external section 21, which gives a user a comfortable gripping surface. The internal section 22 has an outer end 22*a*.

A hollow battery storage handle 24 is attached to the first end 21*a* of the external section 21. The handle 24 is adapted to receive, two D batteries 100. The batteries 100 contact internal battery connections whereby providing power via a power cord 101 to an electric drive motor 50. The power cord 101 connects to a power switch 25 incorporated into the external section 21 in close proximity to the first end 21*a*, and allows a user to turn the powered window washer 10 on or off. The batteries 100 are contained within the handle 24 with a removable storage cap 26. Handle 24 has adapted to it a washing fluid activation button 27, which provides a means of releasing washing fluid held within the washing head assembly 40.

Figure 5:
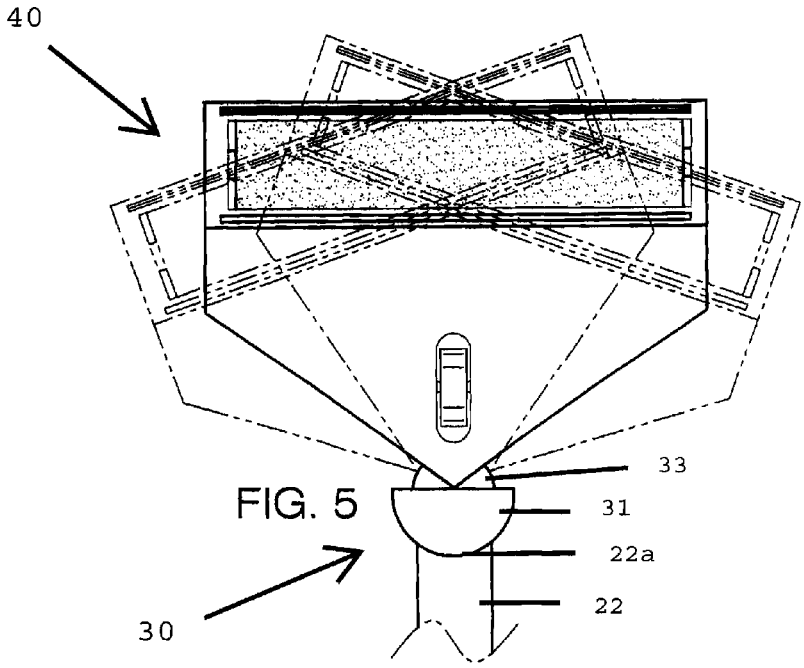
FIG. 5 is a bottom plan view illustrating movement.
Figure 6:
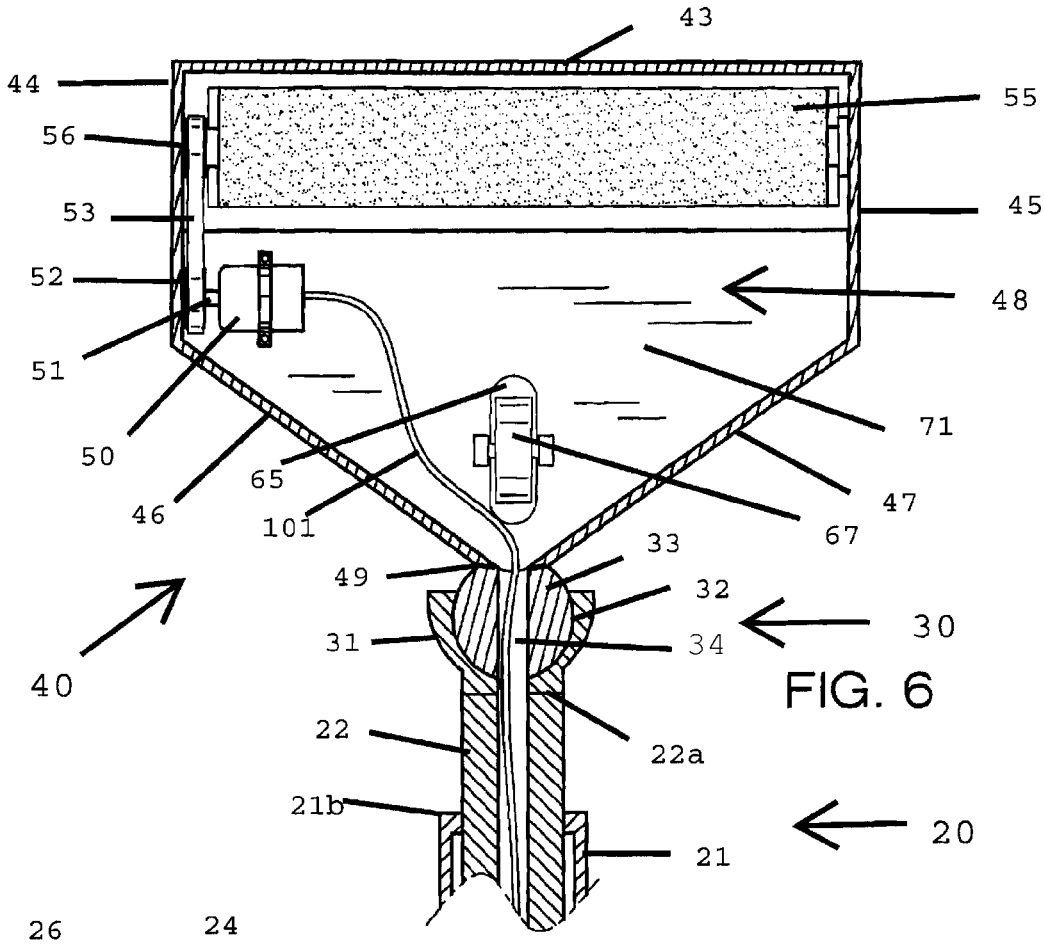
FIG. 6 is a cross sectional view taken along lines 6-6 of FIG. 1.

As illustrated in FIGS. 5 and 6, the handle assembly 20 is connected to the washer head assembly 40 by a swivel assembly 30. The swivel assembly 30 comprises of a swivel socket 31 which has a semi-spherical interior surface 32, a swivel ball 33 and an internal hollow channel 34. The swivel socket 31 is attached to the outer end 22*a* of the internal section 22 of handle assembly 20 and the swivel ball 33 is connected to the washing head assembly 40 at a rear end 49. The swivel socket 31 has semi-spherical interior surface 32, which is adapted to receive the swivel ball 33. The swivel ball 33 is adjustably connected to the inner semi-spherical indention 32. The hollow channel 34 allows the power cord 101 to pass through the interior of the swivel assembly from the handle assembly 20 to the washer head assembly 40. As shown in FIG. 5, the swivel assembly 30 further allows for the connection of the telescopic handle assembly 20 to the washing head assembly 40 and allows the washing head assembly 40 to be adjusted to multiple positions whereby a user is provided comfortable use of the device 10.

The washing head 40 is an irregular pentagon comprising a top plate 41, a bottom plate 42, a front side 43, a right side 44, a left side 45, a right rear side 46 and a left rear side 47 that define an internal cavity 48. The right rear side 46 and the left rear side 47 connect to form a rear end 49 to which the swivel ball 33 is attached.

The bottom plate 42 has a brush slot 60 from which a cylindrical absorbent cleaning brush 55 partially extends outwardly. The brush slot 60 is rectangular having a lead edge 61 and a trailing edge 62. A squeegee 63 is affixed to the lead edge 61. A serrated ice scraper 64 is affixed to the trailing edge 62. The bottom plate 42 also contains a wheel slot 65. The wheel slot 65 allows a wheel 67 to extend outwardly. The wheel 67 elevates the back of the washer 10 allowing the brush 55 to contact the glass surface being cleaned.

A washing fluid cap 70 is removably secured to the top plate 41 has. The cap 70 allows access to an internal washing fluid tank 71 of the internal cavity 48, wherein washing fluid is stored. The washing fluid is excreted through a drip tube (not shown) atop the cleaning brush 55 by depressing the washing fluid activation button 27 located on the battery storage handle 24.

An electric drive motor 50 is mounted within the internal cavity 48. The motor 50 has a drive shaft 51 that extends outwardly away from the motor 50. A drive pulley 52 is attached to the shaft 51. A drive belt 53 passes around the drive pulley 52 continuing around a brush pulley 56, which is attached to the cylindrical cleaning brush 55. The brush 55 is rotationally mounted within the cavity 48 allowing for an unobstructed spinning action when the drive motor 50 is engaged. When the power switch 25 located on the external section 21 is turned to its on position, a circuit is made between the batteries and the electric drive motor 50 giving the motor 50 power. When the drive motor 50 is powered, the outwardly extending drive shaft 51 spins in a single continuous direction, intern rotating the drive pulley 52. The drive pulley 52 connection to the drive belt 53 and the drive belt 53 connection to the brush pulley 56 allows the motor 50 to rotate the brush 55 along a horizontal axis. A user may simply place the washing device 10 on a glass surface and employ the rotationally spinning cleaning brush 55 to scrub the glass without physical strain.

Figure 7:
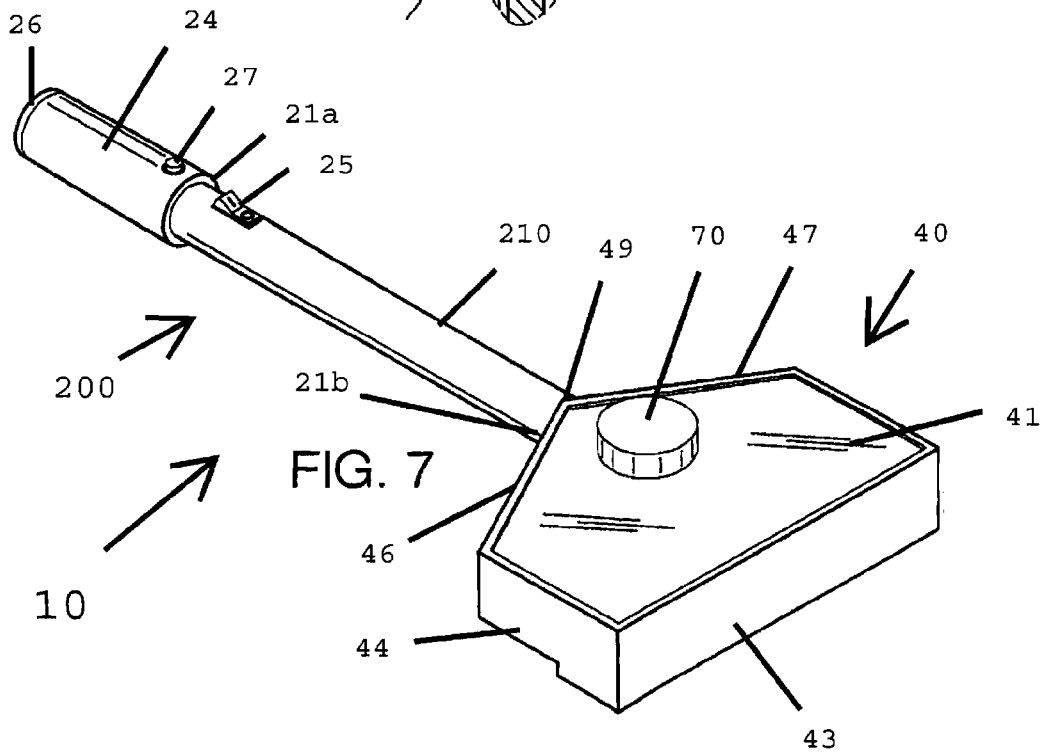
FIG. 7 is a top perspective view illustrating an alternative embodiment.

As shown in FIG. 7, an alternative embodiment of the present powered window washer 10 provides a fixed, non-telescopic handle assembly 200, rather than the telescopic handle assembly 20 of the preferred embodiment. The non-telescopic handle assembly 200 consists of an external section 210 constructed of hollow cylindrical pipe. The external section 210 has a first end 21*a* and a second end 21*b*. A hollow battery storage handle 24 to receive batteries via a removable cap 26 is attached to the first end 21*a* of the external section 210. Otherwise, the alternative embodiment is identical to the preferred embodiment.

With respect to the above description then, it is to be realized that the optimum dimensional relationships for the parts of the powered window washer, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A powered window washer comprising:

a telescopic handle assembly comprising:

a cylindrical external section, constructed of a hollow pipe, comprising:

a first end;

a second end;

a hollow battery storage compartment affixed to said first end, said battery storage compartment comprising a washing fluid button and a removable cap;

a power button located within close proximity to said first end;

a power cord;

a cylindrical grip portion continuously located within close proximity to said second end, a cylindrical internal section constructed of hollow cylindrical pipe, slidingly positioned within said second end of said external section, said internal section comprises an outer end, a swivel assembly comprising:

a swivel socket affixed to said outer end of said internal section of said telescopic handle assembly;

a swivel ball;

an inner semi-spherical indention residing within said swivel socket, wherein said indention adjustably receives said swivel ball;

an internal hollow channel running continuously through the center of said swivel assembly wherein said power cord passes therein, an irregular pentagon shape washer head assembly comprising:

a left side;

a right side;

a front side;

a right rear side connected to a left rear side forming a rear end, wherein said rear end connects to said swivel ball of said swivel assembly;

a bottom plate comprising:

a rectangular brush slot having a lead edge and a trailing edge;

a squeegee perpendicularly affixed to the exterior of said lead edge of said brush slot;

a serrated scraper perpendicularly affixed to the exterior of said trailing edge of said brush slot;

an oval shaped wheel slot centrally located within said bottom plate, top plate comprising a removable washing fluid cap;

an internal cavity defined by said left side, said right side, said front side, said right rear side, said left rear side, said bottom plate and said top plate of said washer head assembly, the internal cavity comprising:

an electric drive motor connected to said power cord, said motor having a protruding drive shaft wherein said drive shaft turns a drive pulley affixed to said drive shaft;

a drive belt, wherein said drive belt rotationally connects said drive pulley to a brush pulley;

a horizontal rotationally mounted cylindrical cleaning brush having an absorbent, abrasive surface, centrally positioned and protruding outwardly from said internal cavity via said brush slot of said bottom plate;

wherein said brush pulley is affixed to said cleaning brush, aligns with said drive pulley, and further is connected to said drive pulley of said electric drive motor by said drive belt;

a wheel rotationally affixed within the center of said wheel slot, wherein said wheel extends outwardly from said internal cavity through said bottom plate; and an internal washing fluid tank disposed within said washer head assembly, said tank accessed by said washing fluid cap.

2. The powered window washer of claim 1 wherein said handle assembly is constructed of hollow aluminum pipe.

3. The powered window washer of claim 1 wherein said washer head assembly is constructed of durable plastic.

4. The powered window washer of claim 2 wherein said handle assembly is extendable to a length of about 24 inches.

5. The powered window washer of claim 2 wherein said handle assembly is extendable to a length of about 48 inches.

* * * * *